US009749726B2

(12) United States Patent
Lee

(10) Patent No.: US 9,749,726 B2
(45) Date of Patent: Aug. 29, 2017

(54) SUPPORT FRAME FOR THIN MINI SPEAKER STRUCTURE AND METHOD OF ASSEMBLING LEAD WIRES TO SUPPORT FRAME OF THIN MINI SPEAKER STRUCTURE

(71) Applicant: FORTUNE GRAND TECHNOLOGY INC., Taoyuan (TW)

(72) Inventor: Ping-Yu Lee, Taoyuan (TW)

(73) Assignee: FORTUNE GRAND TECHNOLOGY INC.

( * ) Notice: Subject to any disclaimer, the term of this patent is extended or adjusted under 35 U.S.C. 154(b) by 0 days.

(21) Appl. No.: 15/013,949

(22) Filed: Feb. 2, 2016

(65) Prior Publication Data

US 2017/0164082 A1 Jun. 8, 2017

(30) Foreign Application Priority Data

Dec. 8, 2015 (TW) ..... 104141033 A

(51) Int. Cl.
*H04R 9/00* (2006.01)
*H04R 1/06* (2006.01)
*H04R 9/06* (2006.01)

(52) U.S. Cl.
CPC ..... *H04R 1/06* (2013.01); *H04R 9/06* (2013.01); *H04R 2307/201* (2013.01)

(58) Field of Classification Search
CPC ..... H04R 9/00; H04R 2909/00
USPC ..... 381/409, 433
See application file for complete search history.

(56) References Cited

U.S. PATENT DOCUMENTS 3,609,652 A * 9/1971 Sebastian ..... H01R 4/50 381/409
4,068,103 A * 1/1978 King ..... H01R 13/04 29/594
5,583,944 A * 12/1996 Morohoshi ..... H04R 9/045 381/400
5,838,809 A * 11/1998 Sato ..... H04R 9/06 381/409
6,794,798 B2 * 9/2004 Watanabe ..... H04R 5/02 310/334
6,922,477 B1 * 7/2005 Ikeyama ..... H04R 1/025 381/409
6,934,399 B2 * 8/2005 Kam ..... H04R 7/045 381/433

(Continued)

*Primary Examiner* — Suhan Ni
(74) *Attorney, Agent, or Firm* — Lynette Wylie; Apex Juris, pllc.

(57) ABSTRACT

A support frame for a thin mini speaker structure thinner than 10 mm includes a main body having a fixing hole, into which a magnet assembly is mounted to locate below a voice coil; two electrically conductive members disposed on the main body; two lead wire holders disposed on the main body between the fixing hole and the electrically conductive members and each defining a lead wire receiving groove thereon; a first damping colloid applied into the lead wire receiving grooves. Two lead wires of the voice coil are set in the first damping colloid in the lead wire receiving grooves and the electrically conductive members to respectively present an outward curved shape. A thin mini speaker lead wire assembling method is also introduced. With the above support frame and method, two ends of the voice coil windings can be directly used as lead wires to save additional tinsel leads.

8 Claims, 8 Drawing Sheets

(56) References Cited

U.S. PATENT DOCUMENTS

| | | | | |
|---|---|---|---|---|
| 7,357,218 | B2 * | 4/2008 | Sasaki | H04R 9/043 381/433 |
| 8,290,200 | B2 * | 10/2012 | Chen | H04R 7/122 381/433 |

* cited by examiner

SUPPORT FRAME FOR THIN MINI SPEAKER STRUCTURE AND METHOD OF ASSEMBLING LEAD WIRES TO SUPPORT FRAME OF THIN MINI SPEAKER STRUCTURE

CROSS-REFERENCE TO RELATED APPLICATION

This non-provisional application claims priority under 35 U.S.C. §119(a) to Patent Application No(s). 104141033 filed in Taiwan, R.O.C. on Dec. 8, 2015, the entire contents of which are hereby incorporated by reference.

FIELD OF THE INVENTION

The present invention relates to a support frame for thin mini speaker structure and a method of assembling lead wires to a support frame of thin mini speaker structure. More particularly, the present invention relates to a support frame for thin mini speaker structure that enables two end portions of voice coil windings to be directly used as lead wires without the need of using additional tinsel leads.

BACKGROUND OF THE INVENTION

A thin mini speaker can be rectangular or circular in shape. For a thin mini speaker configured for high power output, it is not necessary to use tinsel leads and voice coil frame. When the voice coil windings are wound around the voice coil frame, the whole voice coil would be stronger and more stable in structure to sustain even higher power output when being actuated to move. The tinsel lead is a lead wire formed by twisting multiple metal wires together, and can be, for example, a copper alloy twisted wire. The main reason to use tinsel leads is because the voice coil windings are usually formed of a single copper wire or a single copper-clad aluminum wire, which doubtlessly has strength much lower than the tinsel lead formed of multiple twisted metal wires. When two end portions of the voice coil windings are directly used as lead wires to extend from the voice coil frame to an electrical terminal board outside the speaker support frame, the lead wires tend to break when the voice coil moves at very large amplitude. Sometimes, when the amplitude of the voice coil movement is too large, the voice coil tends to collide with other parts of the speaker to cause abnormal sound or reliability problem. When the tinsel leads are used in place of the end portions of the voice coil windings to serve as lead wires, the tinsel leads are connected at their one end to two points on the voice coil frame, at where the end portions of the voice coil windings are terminated, and then, at their another end to electrical contacts on the electrical terminal board outside the speaker support frame. Since the tinsel leads have structural strength and tensile strength much higher than that of the wire forming the voice coil windings, the tinsel leads can sustain the strong pull brought by the movement of the voice coil. In some cases, additional lead wire holders will be further provided on the speaker support frame, and glue will be dispensed to fixedly hold the tinsel leads to the lead wire holders, so that the tinsel leads can be limited to a preset reliable range of vibration amplitude without colliding with other speaker parts. However, the tinsel leads require additional cost and must be fixed to the voice coil frame. For instance, the tinsel leads must be soldered to the voice coil frame at the terminal ends of the voice coil windings, and a protection colloid must be applied to the solder joints to increase the reliability thereof and avoid separation of the tinsel leads from the solder joints when the tinsel leads vibrate and accordingly, failure of the speaker. Therefore, a thin mini speaker structure using tinsel leads is relatively complicated in structure and increased impedance of the voice coil tends to occur at the solder joints of the tinsel leads and the terminal ends of the voice coil windings on the voice coil frame.

It is therefore desirable to develop an improved support frame for thin mini speaker structure and a method of assembling lead wires to support frame of thin mini speaker structure, so that two end portions of the voice coil windings can be directly used as lead wires without the need of using additional tinsel leads.

SUMMARY OF THE INVENTION

A primary object of the present invention is to overcome the drawbacks of the prior art thin mini speaker structure by developing an improved support frame for a thin mini speaker structure and a method of assembling lead wires to a support frame of a thin mini speaker structure, so that two end portions of the voice coil windings can be directly used as lead wires without the need of using additional tinsel leads.

To achieve the above and other objects, the support frame for a thin mini speaker structure according to the present invention is used with a thin mini speaker structure less than 10 mm in thickness and includes a main body, two lead wire holders, a first damping colloid, and two electrically conductive members. The main body is formed with a fixing hole, into which a magnet assembly is mounted to locate below a voice coil, which has two lead wires extended out therefrom. The lead wire holders are disposed on the main body and respectively define a lead wire receiving groove thereon. The first damping colloid is applied into the lead wire receiving grooves. The two electrically conductive members are disposed on the main body for electrically connecting to the two lead wires. The lead wire holders are located between the fixing hole and the electrically conductive members, and the lead wires are set in the first damping colloid applied in the lead wire receiving grooves and the electrically conductive members to respectively present an outward curved shape.

In some embodiments of a support frame according to the present invention, the lead wire holders can include rounded corners.

In another embodiments of a support frame according to the present invention, the lead wire receiving grooves can be each a cross in shape.

In another embodiment of a support frame according to the present invention, the first damping colloid can be an oil-based flexible glue, a water-based flexible glue, or liquid paraffin.

In further embodiments of a support frame according to the present invention, the electrically conductive members respectively include an inside exposed surface, an embedded body and an outside exposed surface, which are sequentially connected to one another. The inside exposed surfaces are located on an inner side of the main body for electrically connecting to the lead wires; the embedded bodies are embedded in the main body; and the outside exposed surfaces are located on an outer side of the main body.

In some embodiments of a support frame according to the present invention, the main body includes two wire organizing slots for holding the lead wires therein, and the two electrically conductive members are located between the lead wire holders and the wire organizing slots.

In other embodiments of a support frame according to the present invention, a protection colloid is further provided for applying on the electrically conductive members to cover and protect electrical connections between the lead wires and the electrically conductive members.

In some embodiments of a support frame according to the present invention, a second damping colloid can be included for applying on the main body at positions between the lead wire holders and the electrically conductive members, so as to hold the lead wires to the main body.

In some embodiments of a support frame according to the present invention, two guide channels are further provided on the main body to locate between the lead wire holders and the electrically conductive members for holding the lead wires in the guide channels.

To achieve the above and other objects, the method of assembling lead wires to a support frame of a thin mini speaker structure according to the present invention is also adapted for a thin mini speaker structure having an overall thickness smaller than 10 mm, and includes the following steps:

(1) provide a main body of the support frame and a voice coil; the main body is provided thereon a fixing hole for holding a magnet assembly therein, two lead wire holders respectively defining a lead wire receiving groove thereon, and two electrically conductive members; the lead wire holders are located between the fixing hole and the electrically conductive members; and the voice coil has two lead wires extended therefrom; and (2) set the voice coil in the fixing hole and separately set the two lead wires in the lead wire receiving grooves and the two electrically conductive members, so that the two lead wires respectively present an outward curved shape; and the lead wires are separately held in the lead wire receiving grooves by a first damping colloid.

In some embodiments, step (1) of the lead wire assembling method according to the present invention, the lead wire holders include rounded corners.

In other embodiments, in step (1) of the lead wire assembling method according to the present invention, the lead wire receiving grooves defined on the lead wire holders are respectively a cross in shape.

In some embodiments, in step (2) of the lead wire assembling method according to the present invention, the first damping colloid is an oil-based flexible glue, a water-based flexible glue, or liquid paraffin.

In further embodiments, in step (1) of the lead wire assembling method according to the present invention, the electrically conductive members respectively include an inside exposed surface, an embedded body and an outside exposed surface, which are sequentially connected to one another. The inside exposed surfaces are located on an inner side of the main body for electrically connecting to the lead wires; the embedded bodies are embedded in the main body; and the outside exposed surfaces are located on an outer side of the main body.

In other embodiments, step (1) of the lead wire assembling method according to the present invention, the main body includes two wire organizing slots, and the two electrically conductive members are located between the lead wire holders and the wire organizing slots. And, in step (2), the lead wires are separately held in the lead wire receiving grooves, the electrically conductive members and the wire organizing slots.

In some embodiments, step (2) of the lead wire assembling method according to the present invention, a protection colloid is further provided for applying on the electrically conductive members to cover and protect electrical connections between the lead wires and the electrically conductive members.

In further embodiments, step (2) of the lead wire assembling method according to the present invention, a second damping colloid is further provided and applied on the main body at positions between the lead wire holders and the electrically conductive members to hold the lead wires to the main body.

In some embodiments, step (1) of the lead wire assembling method according to the present invention, the main body is further provided with two guide channels located between the lead wire holders and the electrically conductive members for holding the lead wires in the guide channels.

With the above support frame for thin mini speaker structure and the method of assembling lead wires to support frame of thin mini speaker structure, the end portions of the windings of the voice coil can be directly used as two lead wires without the need of using additional tinsel leads as the lead wires.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
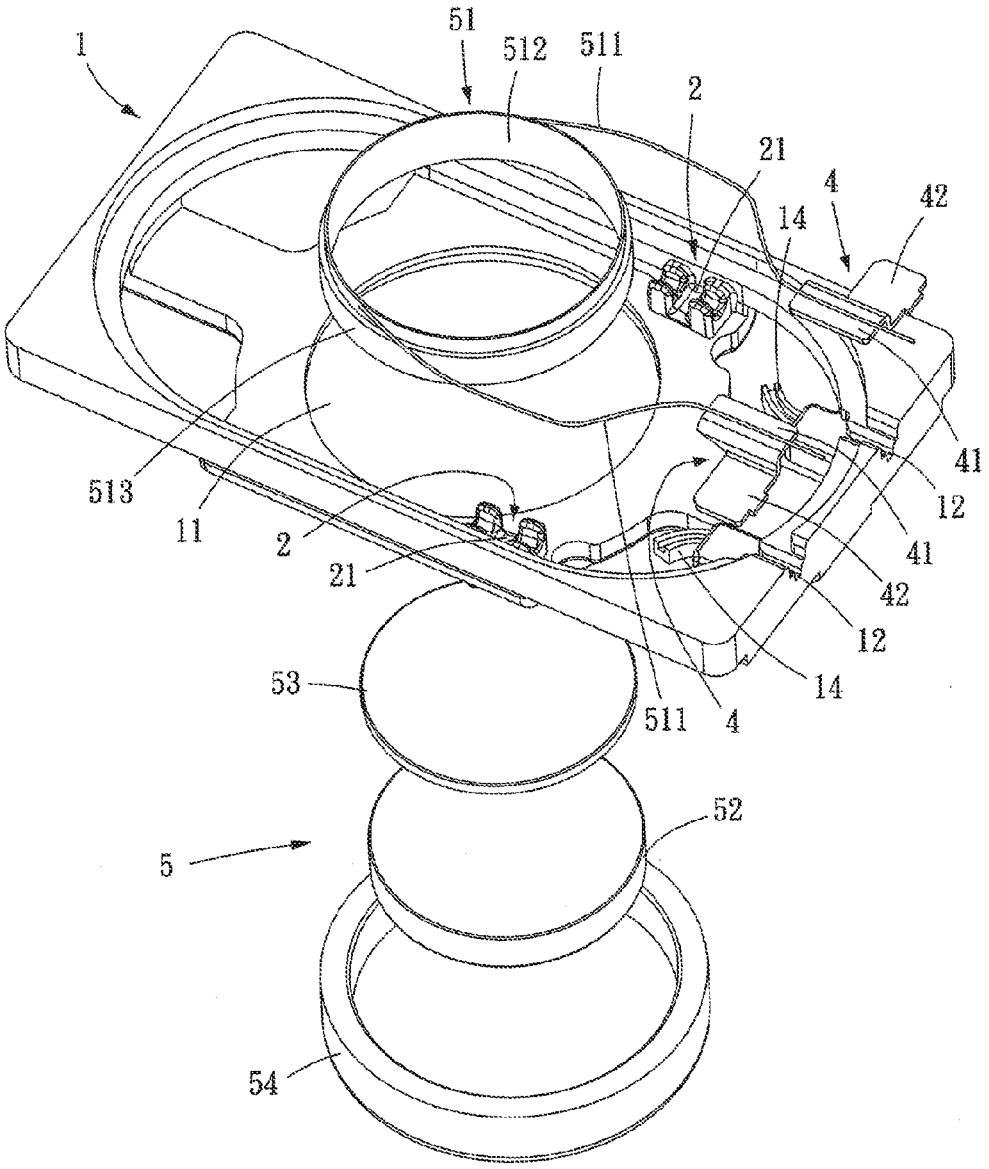
FIG. 1 is an exploded perspective view showing a support frame for thin mini speaker structure according to a first preferred embodiment of the present invention, as well as a support frame, a voice coil and a magnet assembly to be assembled to the support frame.

The present invention will now be described with some preferred embodiments thereof and by referring to the accompanying drawings. For the purpose of easy to understand, elements that are the same in the preferred embodiments are denoted by the same reference numerals.

Figure 2:
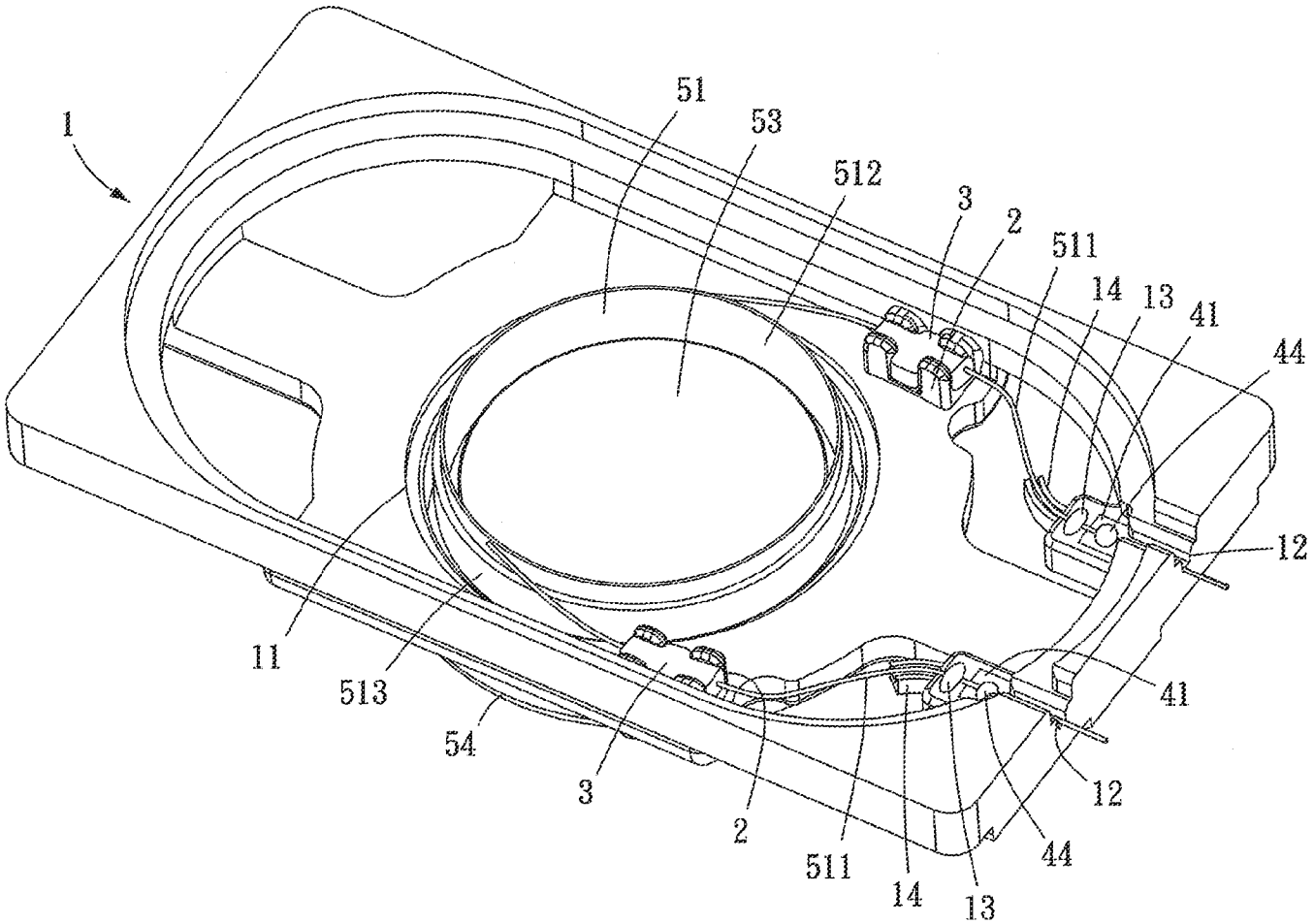
FIG. 2 is an assembled top perspective view of FIG. 1.
Figure 3:
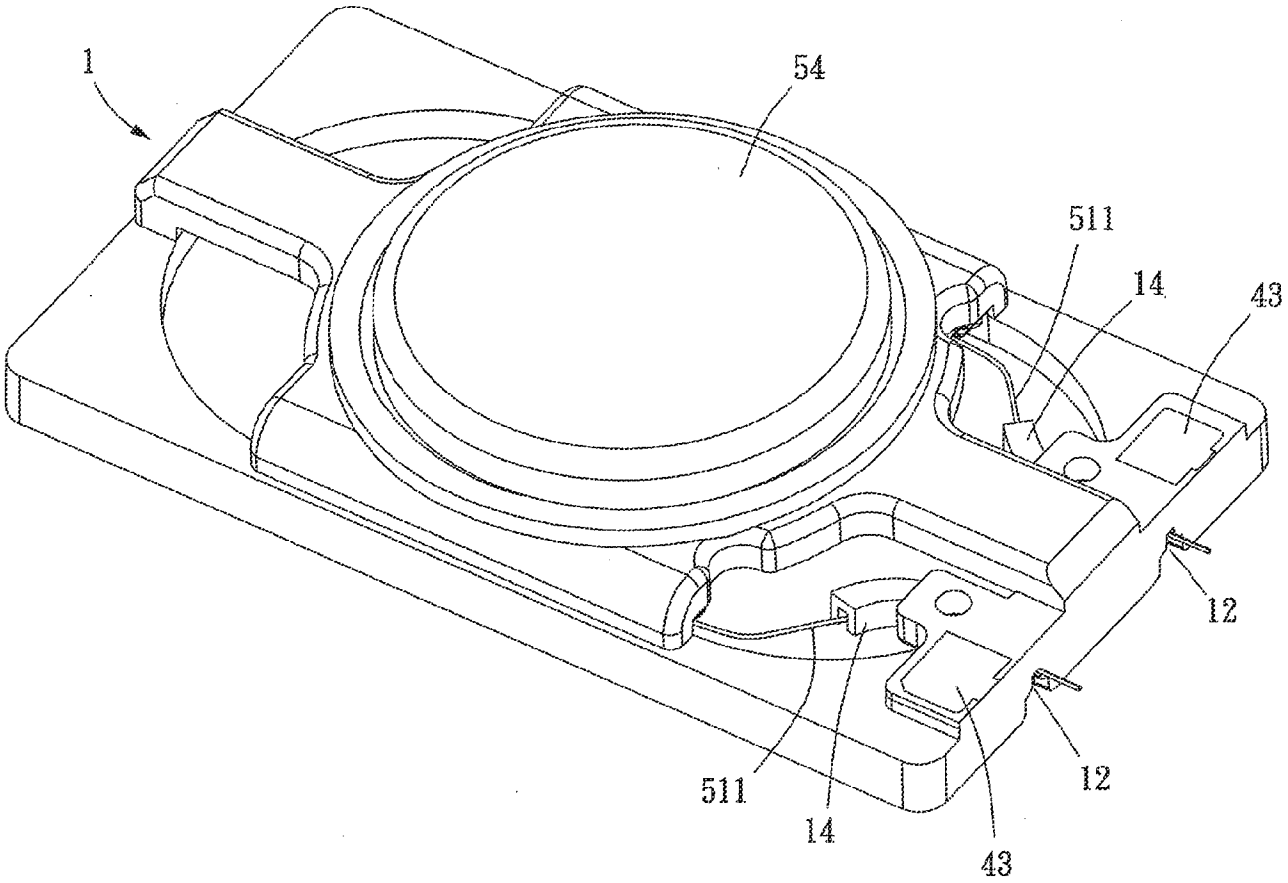
FIG. 3 is a bottom view of FIG. 2.
Figure 4:
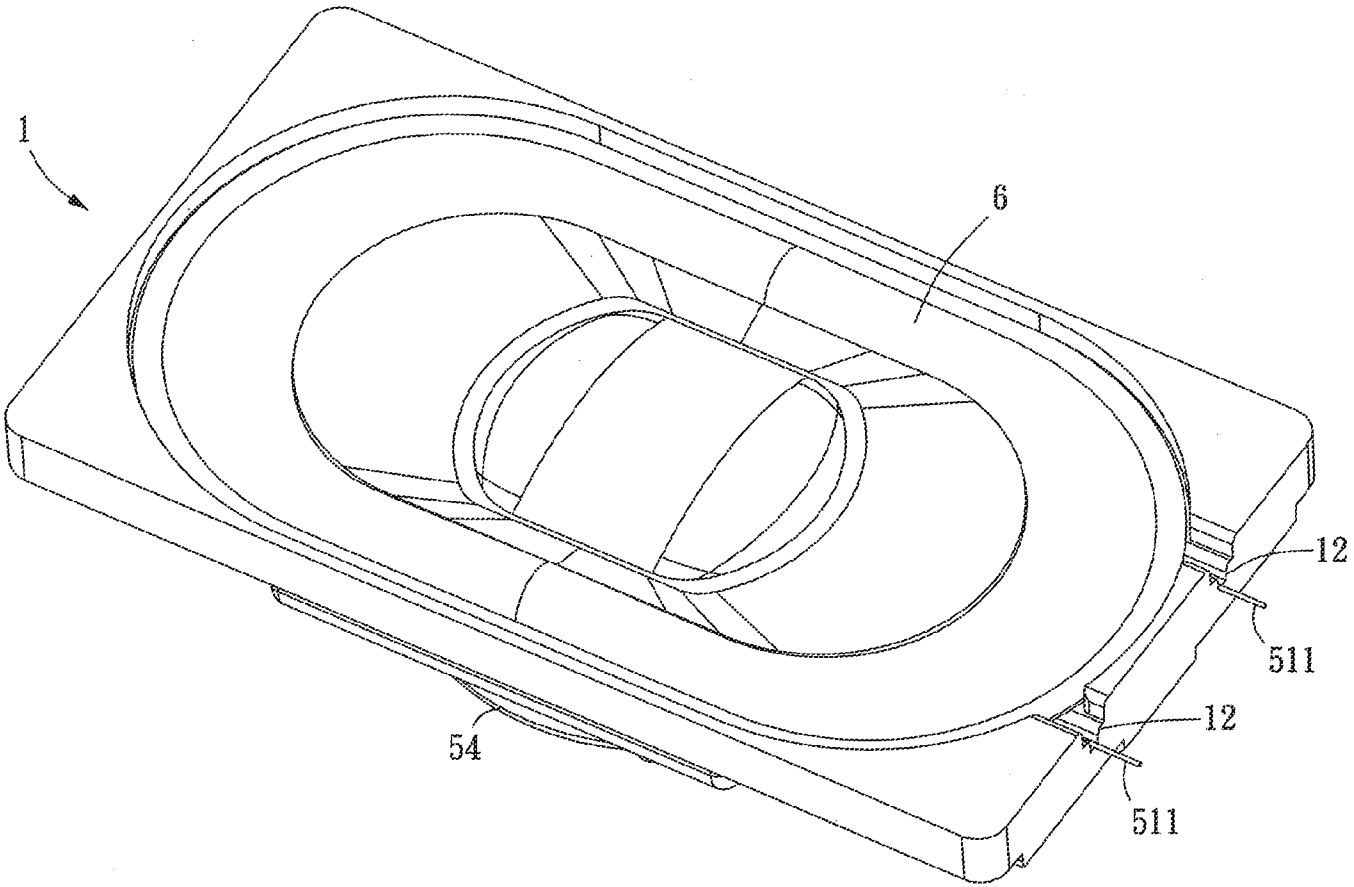
FIG. 4 is a perspective view showing the assembly of FIG. 2 with a diaphragm assembled thereto.
Figure 5:
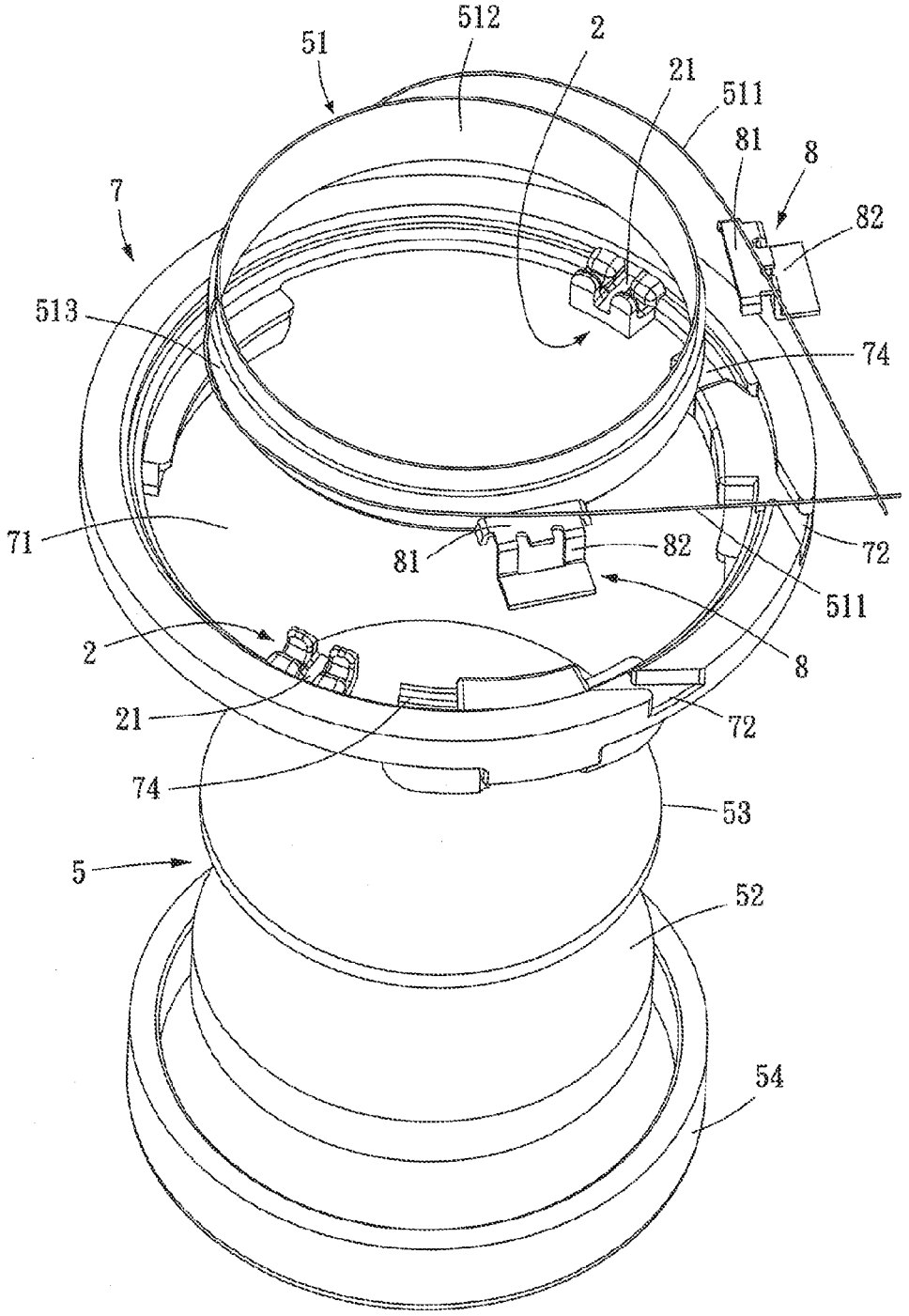
FIG. 5 is an exploded perspective view showing a support frame for thin mini speaker structure according to a second preferred embodiment of the present invention, as well as a support frame, a voice coil and a magnet assembly to be assembled to the support frame.
Figure 6:
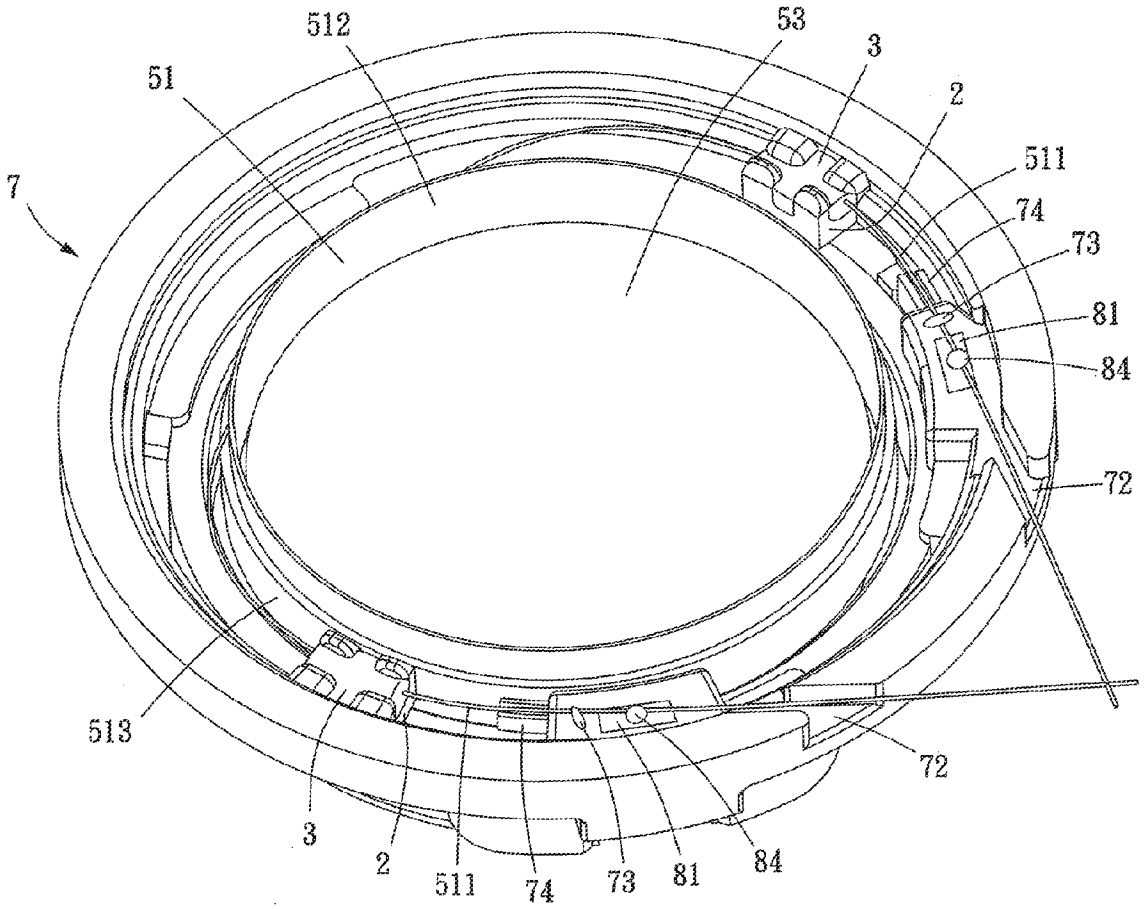
FIG. 6 is an assembled top perspective view of FIG. 5.
Figure 7:
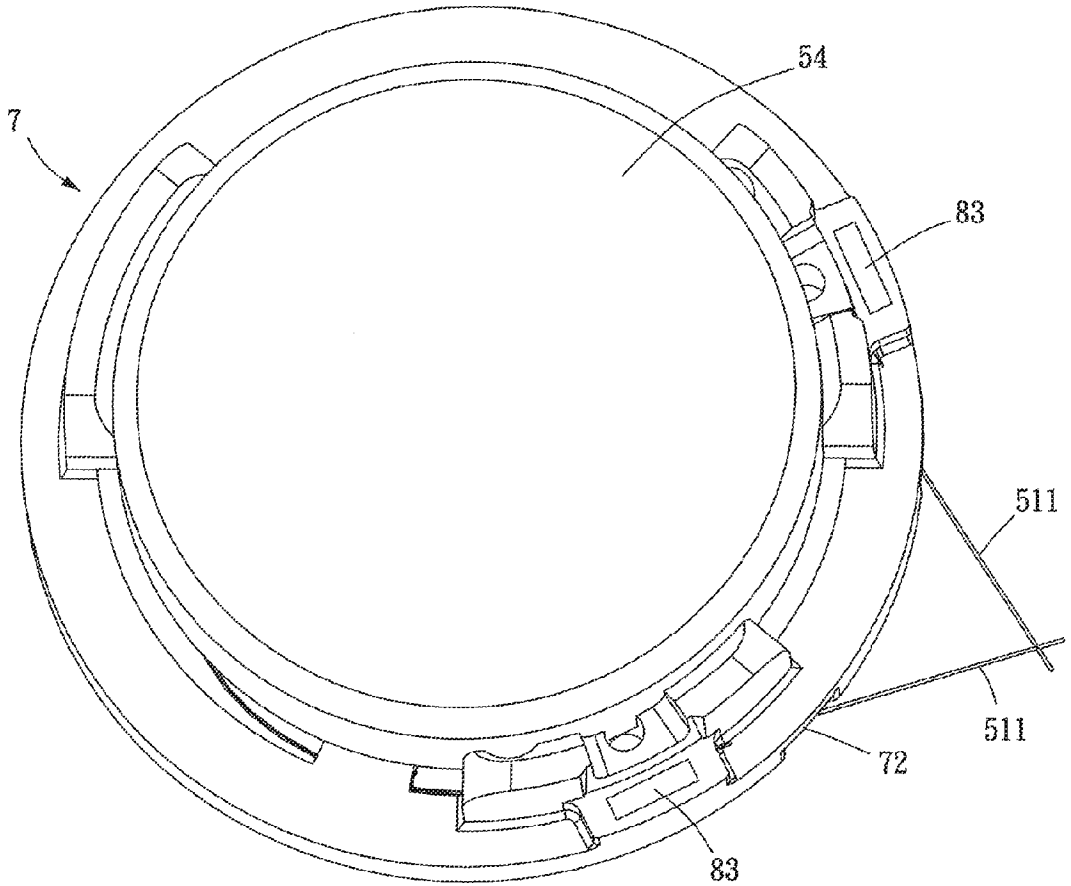
FIG. 7 is a bottom view of FIG. 6.
Figure 8:
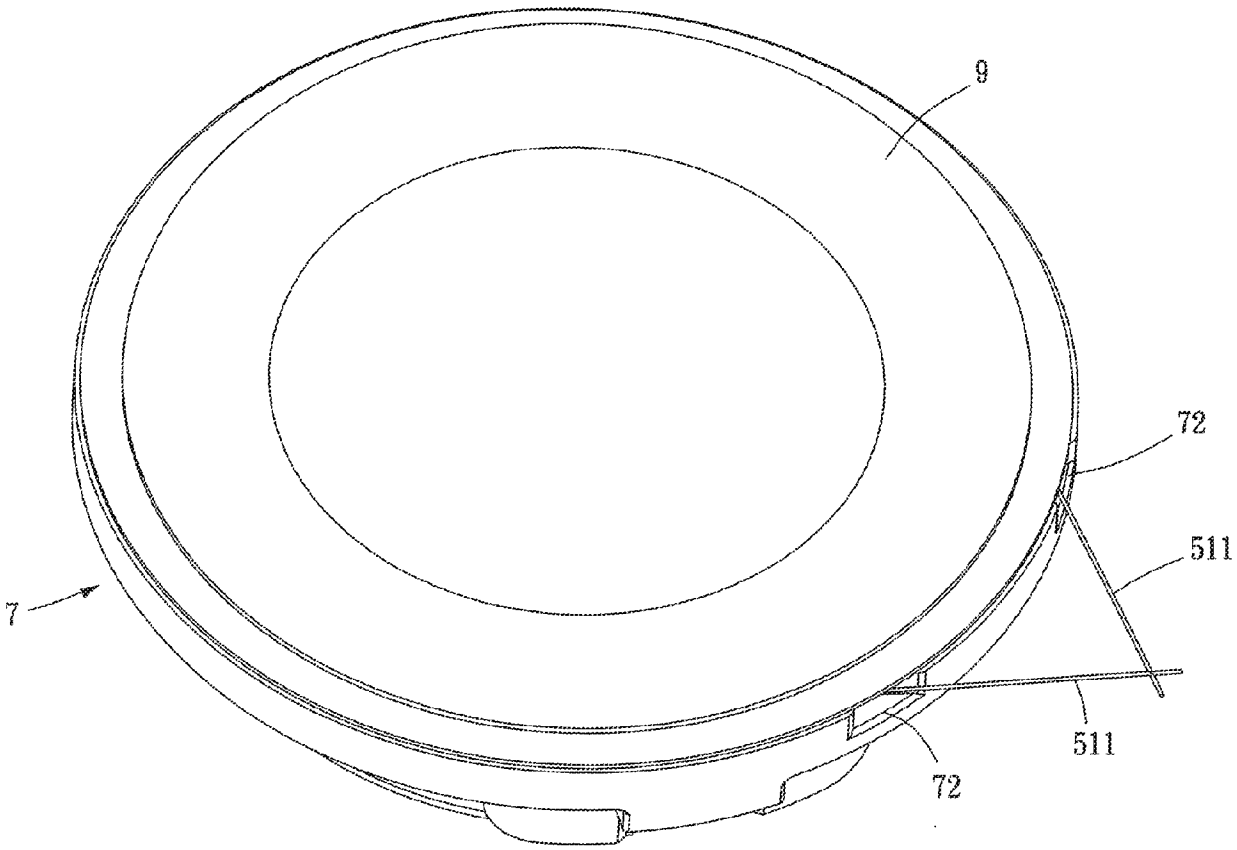
FIG. 8 is a perspective view showing the assembly of FIG. 6 with a diaphragm assembled thereto.

Please refer to FIGS. 1 to 3. As shown, a support frame for thin mini speaker structure according to a first preferred embodiment of the present invention includes a main body 1, two lead wire holders 2, a first damping colloid 3 applied on each of the lead wire holders 2, and two electrically conductive members 4. In the first preferred embodiment, the main body 1 is rectangular in shape. Please also refer to FIGS. 5 and 7, in which a support frame for thin mini speaker structure according to a second preferred embodiment of the present invention is shown. The second preferred embodiment includes a main body, which is circular in shape and denoted by reference numeral 7 herein, two lead wire holders 2, a first damping colloid 3 applied on each of the lead wire holders 2, and two electrically conductive members 8. Herein, the phrase "thin mini speaker structure" refers to a mini speaker structure that has an overall thickness smaller than 10 mm. The main body 1, 7 has a fixing hole 11, 71 centered thereon, into which a magnet assembly 5 is fixedly mounted. The magnet assembly 5 includes a top magnetically permeable plate 53, a magnet 52 and a bottom magnetically permeable element 54, which are sequentially stacked from top to bottom. The magnet assembly 5 is located immediately below a voice coil 51. The voice coil 51 includes an annular frame 512 and toroidal windings 513 fitted around the annular frame 512. Two end portions of the toroidal windings 513 are extended from a left and a right side of the annular frame 512 to serve as two lead wires 511. The bottom magnetically permeable element 54 can be bowl-shaped. With the bottom magnetically permeable element 54, the whole magnet assembly 5 is fixedly mounted in the fixing hole 11, 71. The lead wire holders 2 can be disposed adjacent to an inner side of a left and a right wall portion of the main body 1, 7 and respectively define a lead wire receiving groove 21 thereon. The two lead wire holders 2 can be located at two opposite positions to face each other with a distance between them larger than a diameter of the voice coil 51. The two lead wires 511 are separately set in the lead wire receiving grooves 21 on the lead wire holders 2 to extend from two axial ends of the lead wire receiving grooves 21. In the case of the rectangular main body 1 as shown in FIGS. 1 to 3, the lead wire holders 2 can be located adjacent to two longer sides of the rectangular main body 1. The first damping colloid 3 is applied into the lead wire receiving grooves 21. The first damping colloid 3 is viscous or paste-like to preferably show a low adhesion or also a high lubricating ability. The electrically conductive members 4, 8 are disposed on the main body 1, 7 for electrically connecting to the two lead wires 511. The lead wire holders 2 are located between the fixing hole 11, 71 and the electrically conductive members 4, 8. In the case of the rectangular main body 1 as shown in FIGS. 1 to 3, the two electrically conductive members 4 can be disposed adjacent to one of two shorter sides of the main body 1 to face each other. On the other hand, in the case of the circular main body 7 as shown in FIGS. 5 to 7, the electrically conductive members 8 can be located near a left and a right side of the main body 7 to face each other. The two lead wires 511 are separately set in the first damping colloid 3 in the lead wire receiving grooves 21 and the electrically conductive members 4, 8 to respectively present an outward curved shape. Particularly, please refer to FIGS. 2 and 4 as well as FIGS. 6 and 8. A diaphragm 6, 9 can be assembled to a front side of the main body 1, 7 of the support frame for thin mini speaker structure according to the present invention. More particularly, the main body 1, 7 is formed along an inner peripheral edge with a stepped portion, to which a lower surface of an outer peripheral edge of a surround suspension of the diaphragm 6, 9 is bonded; and meanwhile, a lower surface of an inner peripheral edge of the surround suspension of the diaphragm 6, 9 is bonded to an upper rim of the annular frame 512 of the voice coil 51.

With the above arrangements, the support frame for a thin mini speaker structure according to the present invention is improved compared to the conventional support frame for a thin mini speaker structure. First, with the support frame according to the present invention, no tinsel leads are needed after the magnet assembly 5 is fixed on the support frame; instead, the two lead wires 511 extended from the toroidal windings 513 of the voice coil 51 are further extended to the two electrically conductive members 4, 8 on the main body 1, 7. Second, the two lead wires 511 respectively present an outward curved shape, which allows the lead wires 511 to substantially suspend along the inner peripheral edge of the main body 1, 7. Furthermore, in the present invention, the lead wires 511 set in the lead wire holders 2 are not immovably fixed thereto using the conventional glue dispensing process, but are movably set in the lead wire receiving grooves 21 of the lead wire holders 2 using the viscous or paste-like first damping colloid 3 that has a low adhesion or also a high lubricating ability. Since the first damping colloid 3 is viscous or paste-like and has a certain mass and a low adhesion or also a good lubricating ability, it can suitably limit the vibration amplitude of the lead wires 511. Meanwhile, the first damping colloid 3 allows the lead wires 511 subjected to pull to axially shift in the lead wire holders 2 while the energy generated during the axial shift of the lead wires 511 can be absorbed by the first damping colloid 3 to avoid broken lead wires 511.

Referring to FIGS. 1 and 2 as well as FIGS. 5 and 6. As shown, in the support frame for a thin mini speaker structure according to the present invention, the lead wire holders 2 include rounded corners to lower the possibility of scratching or breaking the lead wires 511.

Also as can be seen in FIGS. 1 and 2 as well as FIGS. 5 and 6, in the support frame for a thin mini speaker structure according to the present invention, the lead wire receiving grooves 21 can be each a cross in shape, so that the lead wire receiving grooves 21 can be filled with the first damping colloid 3 in all directions. Alternatively, each of the lead wire receiving grooves 21 can be simply a straight groove in shape.

In the support frame for a thin mini speaker structure according to the present invention, the first damping colloid 3 can be an oil-based flexible glue or a water-based flexible glue that has a synthetic resin as a major component thereof. Alternatively, the first damping colloid 3 can be a type of synthetic oil with high lubricating ability, such as liquid paraffin.

Referring to FIGS. 1 to 3 as well as FIGS. 5 to 7. In the support frame for a thin mini speaker structure according to the present invention, the electrically conductive members 4, 8 respectively include an inside exposed surface 41, 81, an embedded body 42, 82 and an outside exposed surface 43, 83, which are sequentially connected to one another. The inside exposed surfaces 41, 81 are located on an inner side of the main body 1, 7 for electrically connecting to the lead wires 511. The embedded bodies 42, 82 are embedded in the main body 1, 7 by way of insert molding. The outside exposed surfaces 43, 83 are located on an outer side of the main body 1, 7 for electrically connecting to external electronic elements. The inside exposed surfaces 41, 81 can be flush with or raised from an inner bottom surface of the main body 1, 7; and the outside exposed surfaces 43, 83 can be flush with or raised from an outer bottom surface of the main body 1, 7. Thus, the electrically conductive members 4, 8 can be integrally formed with the main body 1, 7 through insert molding.

As can be seen in FIGS. 1 and 2 as well as FIGS. 5 and 6, in the support frame for a thin mini speaker structure according to the present invention, the main body 1, 7 include two wire organizing slots 12, 72, and the two electrically conductive members 4, 8 are located between the lead wire holders 2 and the wire organizing slots 12, 72. The wire organizing slots 12, 72 are provided for holding the lead wires 511 therein, so that the lead wires 511 respectively present an outward curved shape and portions of the lead wires 511 that are extended beyond the wire organizing slots 12, 72 can be easily cut and removed.

Referring to FIGS. 2 and 6. The support frame for a thin mini speaker structure according to the present invention can further include a protection colloid 44, 84 that is applied on the electrically conductive members 4, 8 to cover and protect electrical connections between the lead wires 511 and the electrically conductive members 4, 8.

As can be seen in FIGS. 2 and 6, the support frame for a thin mini speaker structure according to the present invention can further include a second damping colloid 13, 73 that is applied on the main body 1, 7 at positions between the lead wire holders 2 and the electrically conductive members 4, 8 to hold the lead wires 511 to the main body 1, 7, lest stress should be excessively concentrated at the electrical connections on the electrically conductive members 4, 8 to cause separation of the lead wires 511 from the electrical connections. The second damping colloid 13, 73 can be an oil-based or a water-based flexible glue or liquid paraffin.

Referring to FIGS. 1 to 3 as well as FIGS. 5 and 6. The support frame for a thin mini speaker structure according to the present invention can further include two guide channels 14, 74 provided on the main body 1, 7 to locate between the lead wire holders 2 and the electrically conductive members 4, 8 for holding the lead wires 511 in the guide channels 14, 74.

Referring to FIGS. 1 and 2 as well as FIGS. 5 and 6. The present invention also provides a method of assembling lead wires to a support frame of a thin mini speaker structure. Herein, the phrase "thin mini speaker structure" refers to a mini speaker structure that has an overall thickness smaller than 10 mm. The steps included in the lead wire assembling method according to the present invention are described below:

(1) In a first step, a main body 1, 7 of the support frame and a voice coil 51 are provided. The main body 1, 7 has a fixing hole 11, 71 formed thereon for holding a magnet assembly 5 therein, and has two lead wire holders 2 and two electrically conductive members 4, 8 disposed thereon. The main body 1 can be rectangular in shape, as shown in FIGS. 1 and 2, or be circular in shape, as shown in FIGS. 5 and 6. The voice coil 51 includes an annular frame 512 and toroidal windings 513 fitted around the annular frame 512. Two end portions of the toroidal windings 513 are extended from a left and a right side of the annular frame 512 to serve as two lead wires 511. The lead wire holders 2 can be disposed adjacent to an inner side of a left and a right wall portion of the main body 1, 7 and respectively define a lead wire receiving groove 21 thereon. The two lead wire holders 2 can be located at two opposite positions to face each other with a distance between them larger than a diameter of the voice coil 51. The two lead wires 511 are separately set in the lead wire receiving grooves 21 on the lead wire holders 2 to extend from two axial ends of the lead wire receiving grooves 21. In the case of the rectangular main body 1 as shown in FIGS. 1 to 3, the lead wire holders 2 can be located adjacent to two longer sides of the rectangular main body 1. The electrically conductive members 4, 8 are disposed on the main body 1, 7 for electrically connecting to the two lead wires 511. In the case of the rectangular main body 1 as shown in FIGS. 1 to 3, the two electrically conductive members 4 can be disposed adjacent to one of two shorter sides of the main body 1 to face each other. On the other hand, in the case of the circular main body 7 as shown in FIGS. 5 to 7, the electrically conductive members 8 can be located near a left and a right side of the main body 7 to face each other. And, the two lead wire holders 2 are located between the fixing hole 11, 71 and the electrically conductive members 4, 8.

(2) And, in a second step, the voice coil 51 is set in the fixing hole 11, 71 and the lead wires 511 are separately set in the two lead wire receiving grooves 21 and the electrically conductive members 4, 8, so that the lead wires 511 respectively present an outward curved shape. And, the lead wires 511 are held in the lead wire receiving grooves 21 by a first damping colloid 3. The first damping colloid 3 is viscous or paste-like to preferably show a low adhesion or also a high lubricating ability. According to the method of the present invention, the first damping colloid 3 can be applied into the lead wire receiving grooves 21 first and then the lead wires 511 are set in the first damping colloid 3 that has already been filled in the lead wire receiving grooves 21. Alternatively, the lead wires 511 are set in the lead wire receiving grooves 21 first and then the first damping colloid 3 is applied into the lead wire receiving grooves 21 to cover the lead wires 511.

The fixing hole 11, 71 may be centered on the main body 1, 7 for a magnet assembly 5 to fixedly mount thereinto. After the lead wires 511 of the thin mini speaker structure have been assembled to the lead wire holders 2 and the electrically conductive members 4, 8 according to the method of the present invention, the magnet assembly 5, which has been assembled in advance, is mounted in the fixing hole 11, 71 to locate below the voice coil 51. The magnet assembly 5 includes a top magnetically permeable plate 53, a magnet 52 and a bottom magnetically permeable element 54, which are sequentially stacked from top to bottom. The bottom magnetically permeable element 54 can be bowl-shaped. With the bottom magnetically permeable element 54, the whole magnet assembly 5 is fixedly mounted in the fixing hole 11, 71. Referring to FIGS. 2 and 4 as well as FIGS. 6 and 8, a diaphragm 6, 9 can be assembled to a front side of the main body 1, 7. For this purpose, the main body 1, 7 is formed along an inner peripheral edge with a stepped portion, to which a lower surface of an outer peripheral edge of a surround suspension of the diaphragm 6, 9 is bonded; and meanwhile, a lower surface of an inner peripheral edge of the surround suspension of the diaphragm 6, 9 is bonded to an upper rim of the annular frame 512 of the voice coil 51.

The method of assembling lead wires to a support frame of a thin mini speaker structure is improved compared to the conventional lead wires assembling method. First, with the lead wire assembling method of the present invention, no tinsel leads are needed after the magnet assembly 5 is fixedly mounted in the fixing hole 11, 71 on the main body 1, 7; instead, the two lead wires 511 extended from the toroidal windings 513 of the voice coil 51 are further extended to the two electrically conductive members 4, 8 on the main body 1, 7. Second, the two lead wires 511 respectively present an outward curved shape, which allows the lead wires 511 to substantially suspend along the inner peripheral edge of the main body 1, 7. Furthermore, the lead wires 511 set in the lead wire holders 2 are not immovably fixed thereto using the conventional glue dispensing process, but are movably set in the lead wire receiving grooves 21 of the lead wire holders 2 using the viscous or paste-like first damping colloid 3 that has a low adhesion or also a high lubricating ability. Since the first damping colloid 3 is viscous or paste-like and has a certain mass and a low adhesion or also a good lubricating ability, it can suitably limit the vibration amplitude of the lead wires 511. Meanwhile, the first damping colloid 3 allows the lead wires 511 subjected to pull to axially shift in the lead wire holders 2 while the energy generated during the axial shift of the lead wires 511 can be absorbed by the first damping colloid 3 to avoid broken lead wires 511.

Referring to FIGS. 1 and 2 as well as FIGS. 5 and 6. As shown, in the first step (1) of the lead wire assembling method according to the present invention, the lead wire holders 2 include rounded corners to lower the possibility of scratching or breaking the lead wires 511.

As can be seen in FIGS. 1 and 2 as well as FIGS. 5 and 6, in the first step (1) of the lead wire assembling method according to the present invention, the lead wire receiving grooves 21 can be each a cross in shape, so that the lead wire receiving grooves 21 can be filled with the first damping colloid 3 in all directions. Alternatively, each of the lead wire receiving grooves 21 can be simply a straight groove in shape.

In the second step (2) of the lead wire assembling method according to the present invention, the first damping colloid 3 can be an oil-based flexible glue or a water-based flexible glue that has a synthetic resin as a major component thereof. Alternatively, the first damping colloid 3 can be a type of synthetic oil with high lubricating ability, such as liquid paraffin.

Referring to FIGS. 1 to 3 as well as FIGS. 5 to 7, in the first step (1) of the lead wire assembling method according to the present invention, the electrically conductive members 4, 8 respectively include an inside exposed surface 41, 81, an embedded body 42, 82 and an outside exposed surface 43, 83, which are sequentially connected to one another. The inside exposed surfaces 41, 81 are located on an inner side of the main body 1, 7 for electrically connecting to the lead wires 511. The embedded bodies 42, 82 are embedded in the main body 1, 7 by way of insert molding. The outside exposed surfaces 43, 83 are located on an outer side of the main body 1, 7 for electrically connecting to external electronic elements. The inside exposed surfaces 41, 81 can be flush with or raised from an inner bottom surface of the main body 1, 7; and the outside exposed surfaces 43, 83 can be flush with or raised from an outer bottom surface of the main body 1, 7. Thus, the electrically conductive members 4, 8 can be integrally formed with the main body 1, 7 through insert molding.

Referring to FIGS. 1 and 2 as well as FIGS. 5 and 6, in the first step (1) of the lead wire assembling method according to the present invention, the main body 1, 7 includes two wire organizing slots 12, 72, and the two electrically conductive members 4, 8 are located between the lead wire holders 2 and the wire organizing slots 12, 72. And, in the second step (2) of the lead wire assembling method according to the present invention, the lead wires 511 are set in the lead wire receiving grooves 21, the electrically conductive members 4, 8, and the wire organizing slots 12, 72, so that the lead wires 511 respectively present an outward curved shape and portions of the lead wires 511 that are extended beyond the wire organizing slots 12, 72 can be easily cut and removed.

Referring to FIGS. 2 and 6. In the second step (2) of the lead wire assembling method according to the present invention, a protection colloid 44, 84 can be applied on the electrically conductive members 4, 8 to cover and protect electrical connections between the lead wires 511 and the electrically conductive members 4, 8.

Please refer to FIGS. 2 and 6. In the second step (2) of the lead wire assembling method according to the present invention, a second damping colloid 13, 73 can be further applied on the main body 1, 7 at positions between the lead wire holders 2 and the electrically conductive members 4, 8 to hold the lead wires 511 to the main body 1, 7, lest stress should be excessively concentrated at the electrical connections on the electrically conductive members 4, 8 to cause separation of the lead wires 511 from the electrical connections. The second damping colloid 13, 73 can be an oil-based or a water-based flexible glue or liquid paraffin.

Referring to FIGS. 1 to 3 as well as FIGS. 5 and 6. In the first step (1) of the lead wire assembling method according to the present invention, two guide channels 14, 74 can be further provided on the main body 1, 7 to locate between the lead wire holders 2 and the electrically conductive members 4, 8 for holding the lead wires 511 in the guide channels 14, 74.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A support frame for thin mini speaker structure, the thin mini speaker structure having an overall thickness smaller than 10 mm, and the support frame comprising:

a main body being formed with a fixing hole, into which a magnet assembly is fixedly mounted to locate below a voice coil, which has two lead wires extended out therefrom;

two lead wire holders being disposed on the main body and respectively defining a lead wire receiving groove thereon;

a first damping colloid being applied into each of the lead wire receiving grooves; and two electrically conductive members being disposed on the main body for electrically connecting to the two lead wires;

the lead wire holders being located between the fixing hole and the electrically conductive members, and the lead wires being set in the first damping colloid applied in the lead wire receiving grooves and the electrically conductive members to respectively present an outward curved shape; and wherein the main body includes two wire organizing slots for holding the lead wires therein; and the two electrically conductive members being located between the lead wire holders and the wire organizing slots.

2. The support frame for thin mini speaker structure as claimed in claim 1, wherein the lead wire holders include rounded corners.

3. The support frame for thin mini speaker structure as claimed in claim 1, wherein the lead wire receiving grooves can be each a cross in shape.

4. The support frame for thin mini speaker structure as claimed in claim 1, wherein the first damping colloid is selected from the group consisting of an oil-based flexible glue, a water-based flexible glue, and liquid paraffin.

5. The support frame for thin mini speaker structure as claimed in claim 1, wherein the electrically conductive members respectively include an inside exposed surface, an embedded body and an outside exposed surface, which are sequentially connected to one another; the inside exposed surfaces being located on an inner side of the main body for electrically connecting to the lead wires; the embedded bodies being embedded in the main body; and the outside exposed surfaces being located on an outer side of the main body.

6. The support frame for thin mini speaker structure as claimed in claim 1, further comprising a second damping colloid being applied on the main body at positions between the lead wire holders and the electrically conductive members to hold the lead wires to the main body.

7. The support frame for thin mini speaker structure as claimed in claim 1, further comprising two guide channels provided on the main body to locate between the lead wire holders and the electrically conductive members for holding the lead wires in the guide channels.

8. A support frame for thin mini speaker structure, the thin mini speaker structure having an overall thickness smaller than 10 mm, and the support frame comprising:

a main body being formed with a fixing hole, into which a magnet assembly is fixedly mounted to locate below a voice coil, which has two lead wires extended out therefrom;

two lead wire holders being disposed on the main body and respectively defining a lead wire receiving groove thereon;

a first damping colloid being applied into each of the lead wire receiving grooves;

two electrically conductive members being disposed on the main body for electrically connecting to the two lead wires;

the lead wire holders being located between the fixing hole and the electrically conductive members, and the lead wires being set in the first damping colloid applied in the lead wire receiving grooves and the electrically conductive members to respectively present an outward curved shape; and further comprising two guide channels provided on the main body to locate between the lead wire holders and the electrically conductive members for holding the lead wires in the guide channels.

* * * * *